United States Patent [19]

Mercer, Sr. et al.

[11] 4,181,943

[45] Jan. 1, 1980

[54] SPEED CONTROL DEVICE FOR TRAINS

[76] Inventors: Lloyd I. Mercer, Sr., 211 Englewood, Lufkin, Tex. 75901; Steven B. Hugg, P.O. Drawer 28510, San Antonio, Tex. 78284

[21] Appl. No.: 908,097

[22] Filed: May 22, 1978

[51] Int. Cl.[2] ..... G06F 15/48; B61L 3/00

[52] U.S. Cl. ..... 364/426; 246/182 B; 246/182 C; 364/436

[58] Field of Search ..... 364/426, 431, 436, 438, 364/460; 246/182 R, 182 B, 182 C

[56] References Cited

U.S. PATENT DOCUMENTS

| | | | |
|---|---|---|---|
| 3,582,894 | 6/1971 | Hoyler | 340/168 |
| 3,604,905 | 9/1971 | Riondel | 364/431 |
| 3,639,753 | 2/1972 | Reich | 246/182 C |
| 3,655,962 | 4/1972 | Koch | 364/426 X |
| 3,696,356 | 10/1972 | Franke et al. | 340/213.1 |
| 3,825,672 | 7/1974 | Malon et al. | 174/97 |
| 3,845,289 | 10/1974 | French | 364/436 |
| 3,885,228 | 5/1975 | Katz et al. | 340/47 |
| 4,056,287 | 11/1977 | Gudat | 364/426 X |
| 4,107,253 | 8/1978 | Borg et al. | 364/426 X |

*Primary Examiner*—Jerry Smith
*Attorney, Agent, or Firm*—Gunn & Lee

[57] ABSTRACT

A speed and location programmer located at a particular train station is used to prepare a non-volatile program that may be used by an on board microcomputer to control the speed of a train. The program includes train orders, track conditions, and other relevant information, such as size, length and capacity of the train which may be obtained from a centralized location. The program is fed into a microcomputer which monitors the speed and distance of the train and compares it with the program. If the parameters as contained in the program are exceeded, either the throttle would be reduced or the brakes applied to regulate the speed of the train. A trip history of the train may be extracted at the next train station to determine the operation of the train by the engineer. An override system is included to eliminate the function of the microcomputer in case of emergency. Sensors may be used to determine the number of rotations of the train wheel and thereby compute the speed and distance of the train. An operator's console provides for activation of the system and allows for periodic updates of the system.

20 Claims, 7 Drawing Figures

SPEED AND DISTANCE SENSOR

THROTTLE AND/OR BRAKING CONTROL

OPERATOR CONSOLE

MICROCOMPUTER

FLOWCHART

SPEED CONTROL DEVICE FOR TRAINS

BACKGROUND OF THE INVENTION

The present invention relates to a speed control device for trains and, more particularly, to an on board microcomputer that is programmed to include local train orders, track conditions, and other information provided by a centralized location. The information programmed into the microcomputer is used to control operation of the train.

BRIEF DESCRIPTION OF THE PRIOR ART

Prior to the present invention, many different types of systems have been used to control or regulate the operation of trains. A typical system is to use wayside markers to indicate the condition of the track and the maximum speed allowable over that portion of the track. However, a wayside marker systems may be obeyed by the engineer of the train, or totally ignored depending upon the time schedule facing the engineer. While all railroad companies emphasize safety first, they also emphasize the train schedule which may be totally impossible to meet if the train is operated within the speed limitations set by the train order.

While exceeding the speed given in the train order is in violation of the safety regulations for which the engineer may be fired, an equally or more important consideration is the fact that the roadbed is being seriously damaged with each speeding train that travels thereon. As the train exceeds the speed limit, the force of the wheels against the rails have a tendency to loosen or bend the rails thereby resulting in train derailments with the attendant damage to property and possible loss of life. Excessive speeds of trains is probably the leading cause of damage to the roadbeds, and consequently the leading cause of derailments.

Numerous methods have been used in the past in an attempt to regulate or control the speed of trains without taking away the function of the train engineer. One method has been the use of continuous radio communications from a ground location to a control unit aboard the train. As is the normal case for radio communications back and forth between a stationery and moving transmitter and/or receiver, the radio communications become lost. The radio transmissions may be overridden by other signals or blocked by the terrain, such as mountains or tunnels.

On board computers have been used in the past for such purposes as controlling the spacing between trains as shown in U.S. Pat. No. 3,885,228 issued to Katz, et al. If worse case conditions are exceeded depending upon the frequencies being transmitted and received, the brakes of the train are applied. Again, interference with either the transmitting or receiving signal could cause a failure of the supposed fail-safe system.

Other systems have been devised in the past to insure the maximum efficiency of operation of a train as shown in Riondel (U.S. Pat. No. 3,604,905). Once the train reaches a particular predetermined point, the motors of the train are cut off and allowed to coast to its particular destination thereby minimizing the amount of fuel required by the train and minimizing the requirements for braking. The system as shown in Riondel is concerned with the maximum efficiency of operation of the train, and not a predetermined order for operation of the train inside of set tolerances.

Other types of devices that have used wayside equipment that would transmit a signal to the train, or receive a signal from a train, depend upon the proper operation of the wayside equipment. A typical such device is shown in Mallon (U.S. Pat. No. 3,825,672) which emits or receives electrical signals as a result of the movement of the train along the track. Various portions of the device extend perpendicular to the direction of travel of the train and the track so that signals are produced by induction current.

In another system that requires the transmitting and receiving of a signal by the train from a location other than on board the train is shown in Franke (U.S. Pat. No. 3,696,356). A series of control signals are received by the train. The most restrictive control signal received by the train will activate an alarm indicator for acknowledgment by the operator of the train. If the alarm is not acknowledged by the operator, the brakes for the train would be applied to stop the train. However, the system as shown in Franke requires the transmitting or receiving of control signals from other locations. To receive such control signals with any assured degree of accuracy, wayside equipment would be needed along the track of the train between stations.

Other types of systems have been devised to determine if the operator of a train is alert by sending periodic signals that must be acknowledged by the train operator. If the train operator fails to acknowledge the signal within a predetermined time, then the brakes of the train would be applied. Other devices, such as the "deadman's control", have been used to insure that the operator of the train is still physically at his post and operating the train. However, such devices have been disarmed by putting a heavy weight on the "deadman's control".

As a typical example of a coded transmitted signal being used to control a train from a fixed location is shown in Hoyler (U.S. Pat. No. 3,582,894). However, again this typical example has all of the attendant problems that could be caused if a part or all of the transmitted signal is not received by the train.

The problems discussed hereinabove are just some of the numerous problems with controlling and insuring the proper operation of the train within the speed limits thereby insuring the maximum safety as is emphasized by the railroad industry. It becomes essential to have some type of device that insures that the train is operating within the predetermined speed limits thereby decreasing the possibility of derailment and/or damage to the tracks.

SUMMARY OF THE INVENTION

It is an object of the present invention to control the speed of a train through a preprogrammed on board computer.

It is still another object of the present invention to control the speed of a train by preparing a program at a train station which includes train orders, track conditions and other information, which program is physically inserted on an on board microcomputer prior to departure of the train from the station. If the maximum speed limit as set in the program are exceeded as determined by speed and distance sensors, the speed of the train will be reduced via a throttle control, or the train will be stopped through an application of the train brakes. The history of the train movement is recorded in a non-volatile memory, which non-volatile memory can be removed upon completion of the trip. An override system is provided wherein the engineer may override the computer in case of failure to resume control of the train. However, in the event of overriding the operation of the computer, that information will also be recorded in the trip history stored in the non-volatile memory. The on board system includes an operator's console wherein the information being fed into the on board computer can be periodically updated as various mileposts are passed. Warning and indication lights are also included on the operator's console to indicate such information as siding, reverse movement of the train, or other typical information.

DESCRIPTION OF THE PREFERRED EMBODIMENT

Figure 1:
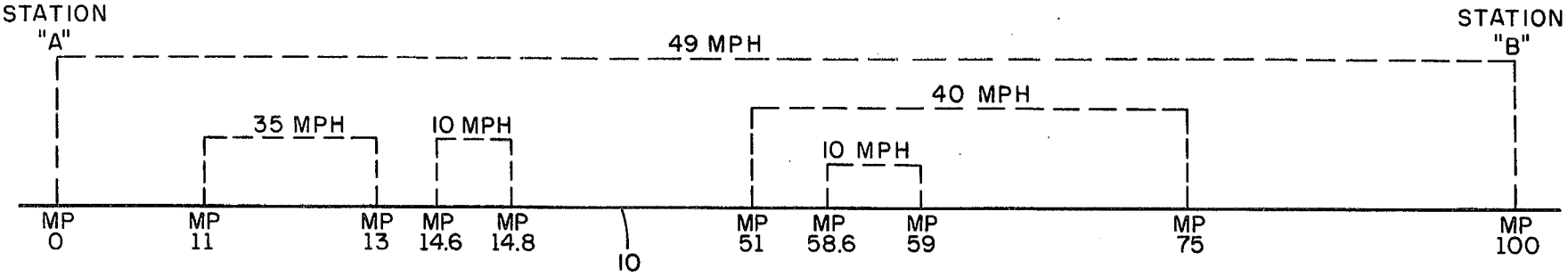
FIG. 1 is a distance diagram indicating typical maximum allowable speeds between Station A and Station B.

Referring to FIG. 1 of the drawings, there is shown on an illustrative linear scale typical miles per hour restrictions between Train Station A and Train Station B as may occur along the track illustrated by reference numeral 10. The terms "miles per hour" are abbreviated MPH, and the terms "mile post" ar abbreviated MP. From Station A (or MP-0) to MP-11, the train may travel at its maximum speed as permitted by the track of 49 MPH. However, at MP-11, the train must reduce its speed to 35 MPH and not exceed that speed until it reaches MP-13. At MP-13, the train can resume the maximum speed of 49 MPH. However, upon reach MP-14.6, the train must again reduce its speed until it reaches MP-14.8. Such a low speed could be caused by conditions of the track, busy intersections or other normal or abnormal occurrences. After reaching MP-14.8, the train could again resume the maximum speed of 49 MPH and maintain that speed until it reaches MP-51. At MP-51, the train must reduce speed to 40 MPH. At MP-58.6, the train must further reduce its speed to 10 MPH and not exceed that speed until it reaches MP-59. However, at MP-59, the 40 MPH restriction still applies, therefore the train can resume a speed of 40 MPH and maintain that speed until it reaches MP-75. At MP-75, the train can resume its maximum speed of 49 MPH and maintain that speed until MP-100.

The above explanation of FIG. 1 and the restrictions along the track 10 as shown in FIG. 1 are simply typical restrictions that an engineer of a train could expect to have to meet in the normal operation of the train. With this invention, a method and apparatus is shown for controlling the speed of a train so that if the engineer ever exceeds the maximum speed limitations, the speed of the train will be automatically reduced or the train will be stopped by the application of the brakes.

Figure 2:
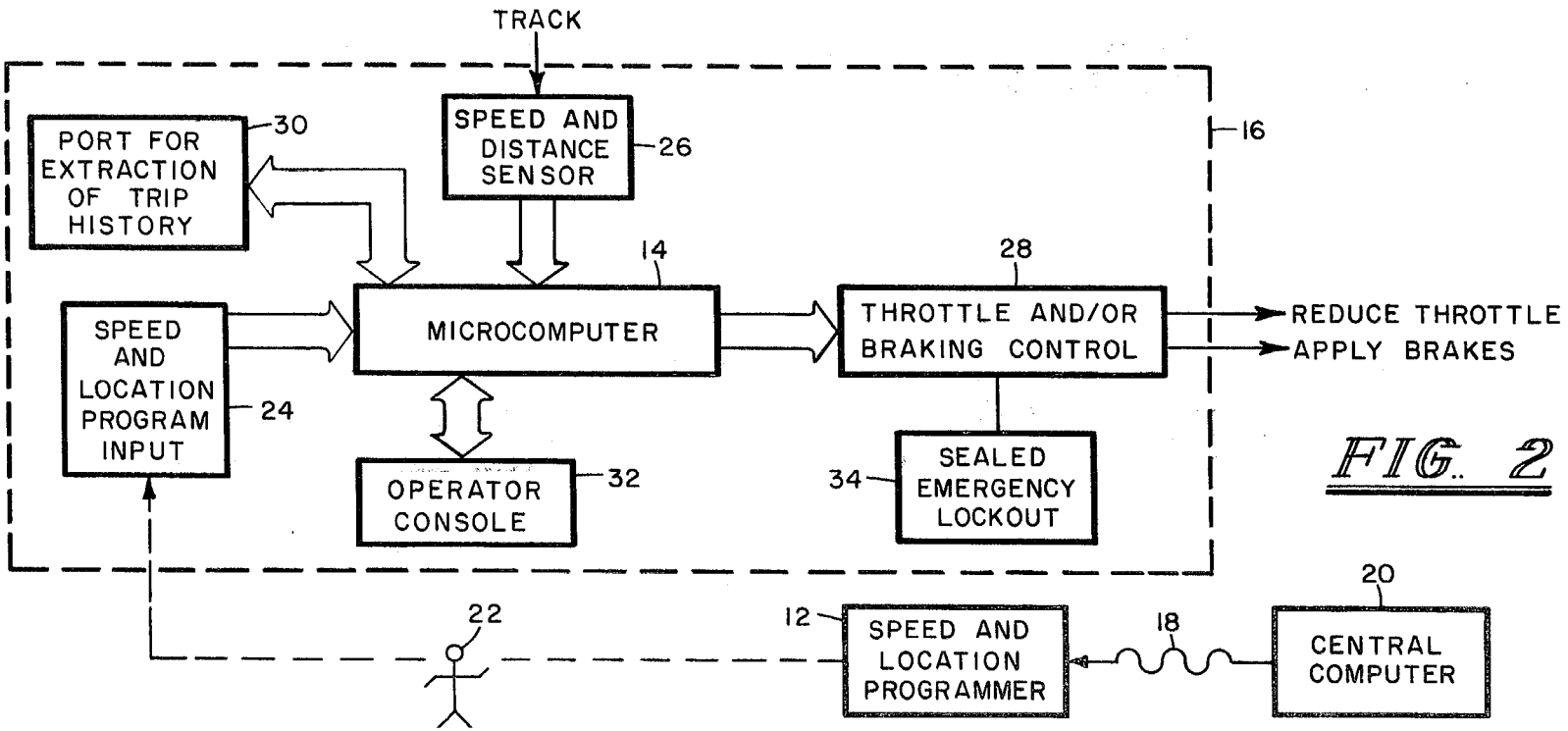
FIG. 2 is an illustrative block diagram of an apparatus used to control the speed of a train.

The general concept for controlling the speed of the train between Station A and Station B, or along any other track that would require train orders to implement the particular restrictions, is shown in the general block diagram of FIG. 2. At Station A (or the station from which the train is leaving) is located a speed and location programmer 12. The speed and location programmer 12 is used to compile a program that implements the train order or other restrictions and/or conditions into a format that may be used by the microcomputer 14 located on board the train 16. The speed and location programmer 12 may have a phone link to a central computer 20 that contains other information, such as other trains traveling along the track 10, size, length and weight of the train 16, or other miscellaneous information. All of the information necessary from the central computer 20 is also programmed by the speed and location programmer 12 at Station A. The information from the speed and location programmer 12 is physically carried by an individual 22 and fed into the microcomputer 14 through speed and location program input 24. The physical program may be in any non-volatile form, such as punched tape, or a magnetic card reading device. These or any other type of non-volatile program that will not lose its memory in case of loss of power may be used for controlling the operation of the microcomputer 14. The speed and location program input 24 converts speed into distance, and from the train orders programmed therein will feed the correct information into the microcomputer 14.

The speed between the track 10 and the train 16 is continually monitored by a speed and distance sensor 26. The speed and distance sensor 26 may be of any conventional type, such as a magnetic pickup device that gives a pulse output signal with the frequency of the pulses being dependent upon the rotational velocity of the wheel. Slippage between the wheel and the track does not become a real problem because the amount of slippage is very minimal. Also, procedures as will be explained hereinbelow are included for updating the program depending upon the location along the track. However, if a more positive or true ground speed is desired, many other types of speed and distance sensors, such as the Doppler radar or fifth wheel, may be used to determine true speed between the train 16 and the track. The output from the speed and distance sensor 26 is fed into microcomputer 14 and compared with the input from the speed and location program input 24. If the speed of a train 16 exceeds the maximum speed limitation, microcomputer 14 will give an output to the throttle and/or braking control 28. The throttle and/or braking control 28 may either reduce the throttle or apply the brakes of the train depending upon the design of the particular system.

Trip history of the train 16 is fed from the microcomputer 14 into a port for extraction of trip history 30 wherein operation of the train 16 versus the program being fed into the microcomputer 14 is recorded in a non-volatile memory. At the completion of the trip, the trip history is extracted from the port for extraction 30. This is particularly important in case of an accident of the train for proving either the safe or unsafe operation of the train 16. Various functions may be necessary by the operator or engineer of the train 16 as is provided through operator console 32. Operator functions, such as updating the location of the train 16 or moving the train 16 into a siding, is controlled by operator console 32.

In case there happens to be a failure in the microcomputer 14 or related equipment, a sealed emergency lockout 34 is provided. The sealed emergency lockout 34 may be a sealed compartment that, if opened by the operator, would be easily recognized as having been opened once the train 16 arrived at the next station. The sealed emergency lockout 34 would bypass the entire system to release the throttle and/or braking control 28 and return operation of the train 16 to the engineer.

In the preparing of the train order, certain information is included that is only known at the local train station, and certain information that would only be known at a centralized location and stored in the central computer 20. However, if the present system becomes a standard item, the speed and location programmer and the central computer 20 may both be combined at one location with simply a printout reading device being used at the individual train station for preparing the program (train order) as would be received by the speed and location program input 24. Once the program is fed into the microcomputer 14, the program is checked by the microcomputer 14 in a manner as will be subsequently described, to make sure that the program is valid. Once that is accomplished, control of the train 16 is turned over to the operator through the operator console 32. After the train 16 has left Station A or the train yard, the engineer will be signaled that he must press an acknowledgment button upon reaching the first mile post. If the acknowledgment button is not pushed, microcomputer 14 will stop the train 16 by applying the brakes via throttle and/or braking control 28. However, if the engineer pushes the acknowledgment button, the entire system as shown in FIG. 2 will be activated and a maximum speed of the train 16 will be limited as determined by the program (train order).

The port for extraction of trip history 30 may be a very simply check to determine if there have been any speed violations in case of derailment of the train 16. Also, it could be used so that when the train 16 arrived at the next station or train yard, the system as shown in FIG. 2 could be interrogated to determine if there have been any speeding violations. All that is necessary is to have a reading device that would connect to the microcomputer 14 with a non-volatile memory being located in the port for extraction of trip history 30.

Figure 3:
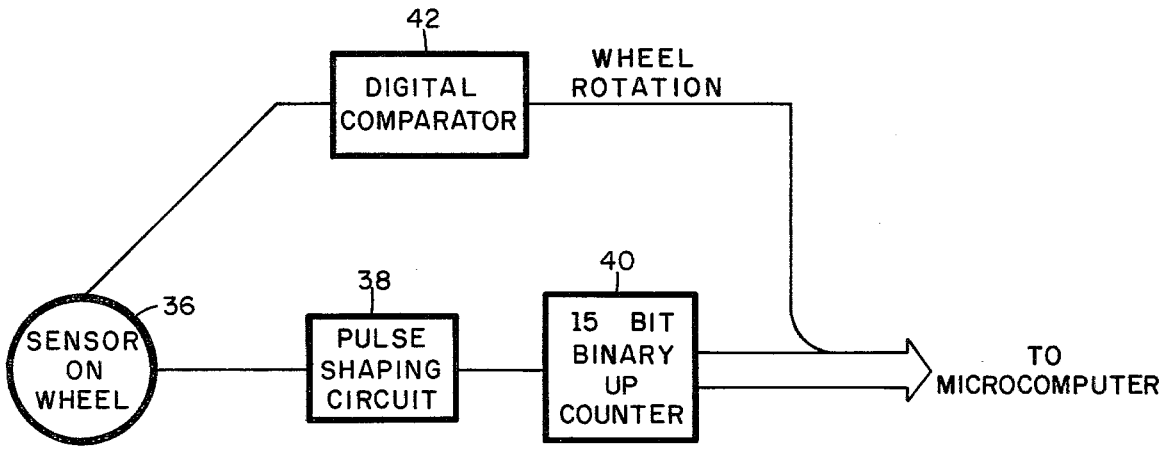
FIG. 3 is a detailed block diagram of a speed and distance sensor shown in FIG. 2.

The speed and distance sensor 26 is basically a pulse shaper that will give a series of pulse waveform outputs in a type that can be used by the microcomputer 14. Referring to FIG. 3, the speed and distance sensor 26 is shown to also include a sensor 36 on the wheel of the train 16, which sensor 36 may be of any conventional type such as a magnetic pickup device. Optical pickups or any other types of sensors could be used to measure the rotation of the wheel, or sensors detecting the speed of the train 16 with respect to the track 10 (such as a Doppler radar), could be used. The sensor 36 feeds an output signal into a pulse shaping circuit 38 which could consist of a Schmidt trigger. The output from the pulse shaping circuit 38 is fed into a 15 bit binary-up-counter 40 which output is fed into microcomputer 14. By the use of a binary-up-counter 40 for the pulses, a very convenient means to determine the speed is provided by the number of counts per a given period of time. The digital comparator 42, which also gives an output signal to the microcomputer 14, simply determines the direction of movement of the train 16, either in the forward or reverse direction. The outputs from the digital comparator 42 and the 15 bit binary-up-counter 40 are fed into the microcomputer 14 through a normal cable buss connection. Reverse movements of the train 16 are also recorded in the trip history and included to give the exact location of the train.

Figure 4:
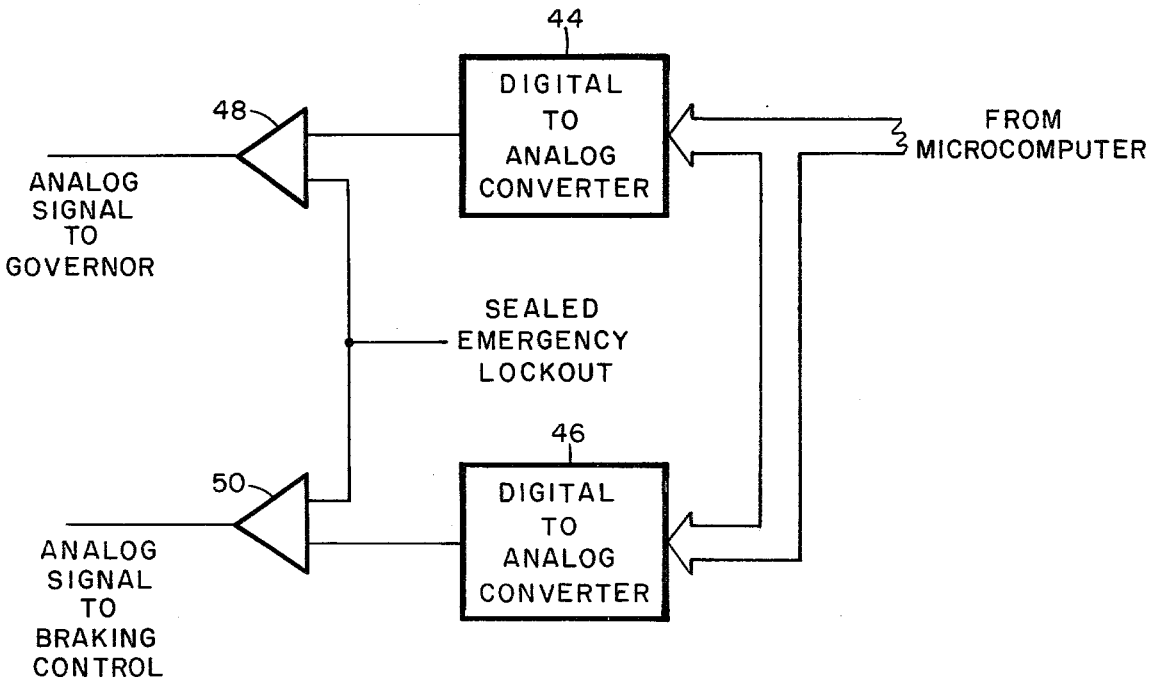
FIG. 4 is a detailed block diagram of throttle and braking control shown in FIG. 2.

Referring to FIG. 4 of the drawings, there is shown a throttle and/or braking control 28 which is basically a parallel system that may use the digital output from the microcomputer 14 to either apply the brakes, reduce the throttle, or both, for the train 16 if it exceeds the maximum speed limit. The signal from the microcomputer 14 is converted to digital analog form by digital-to-analog converters 44 and 46. The outputs from the digital-to-analog converters 44 and 46 feed through amplifiers 48 and 50, respectively, to drive either a governor or a braking control. The reason analog signals are necessary is because trains presently use analog signals to operate either the throttle or the braking controls. Currently, trains are not operated by digital signals but by analog signals. Again, the sealed emergency lockout 34 may feed through either amplifier 48 or amplifier 50 upon the braking of the seal thereby preventing an output from either amplifier 48 or 50 to regulate the throttle or apply the brakes.

Normally either a throttle control or a braking control would be mutually exclusive of each other. With a braking control, if the operator of the train 16 exceeded the speed limit, then the train 16 would be stopped thereby emphasizing the violation by the operator. If the speed limit is exceeded in a throttle control and a governor is used, then control by the engineer is removed only if the engineer exceeds the predetermined speed limit, which violation is recorded in the trip history which is subsequently extracted via the port for extraction of trip history 30. By using the throttle control, the engineer would have full control if he was operating within the predetermined speed limits. By use of the braking control, it becomes blatant that the engineer has violated the speed limits when his train is stopped on the tracks.

Figure 5:
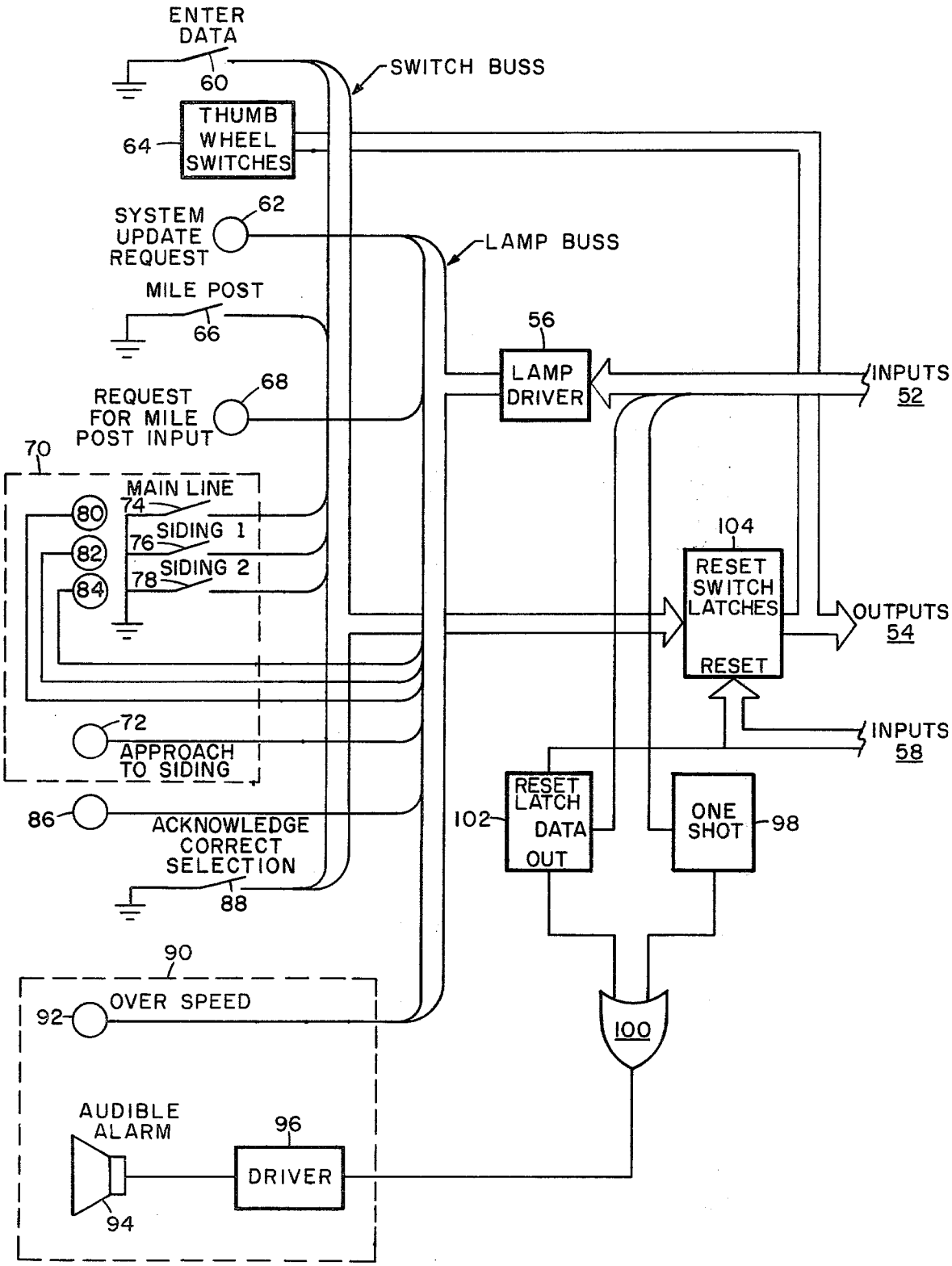
FIG. 5 is a detailed block diagram of a typical operator console shown in FIG. 2.
Figure 6:
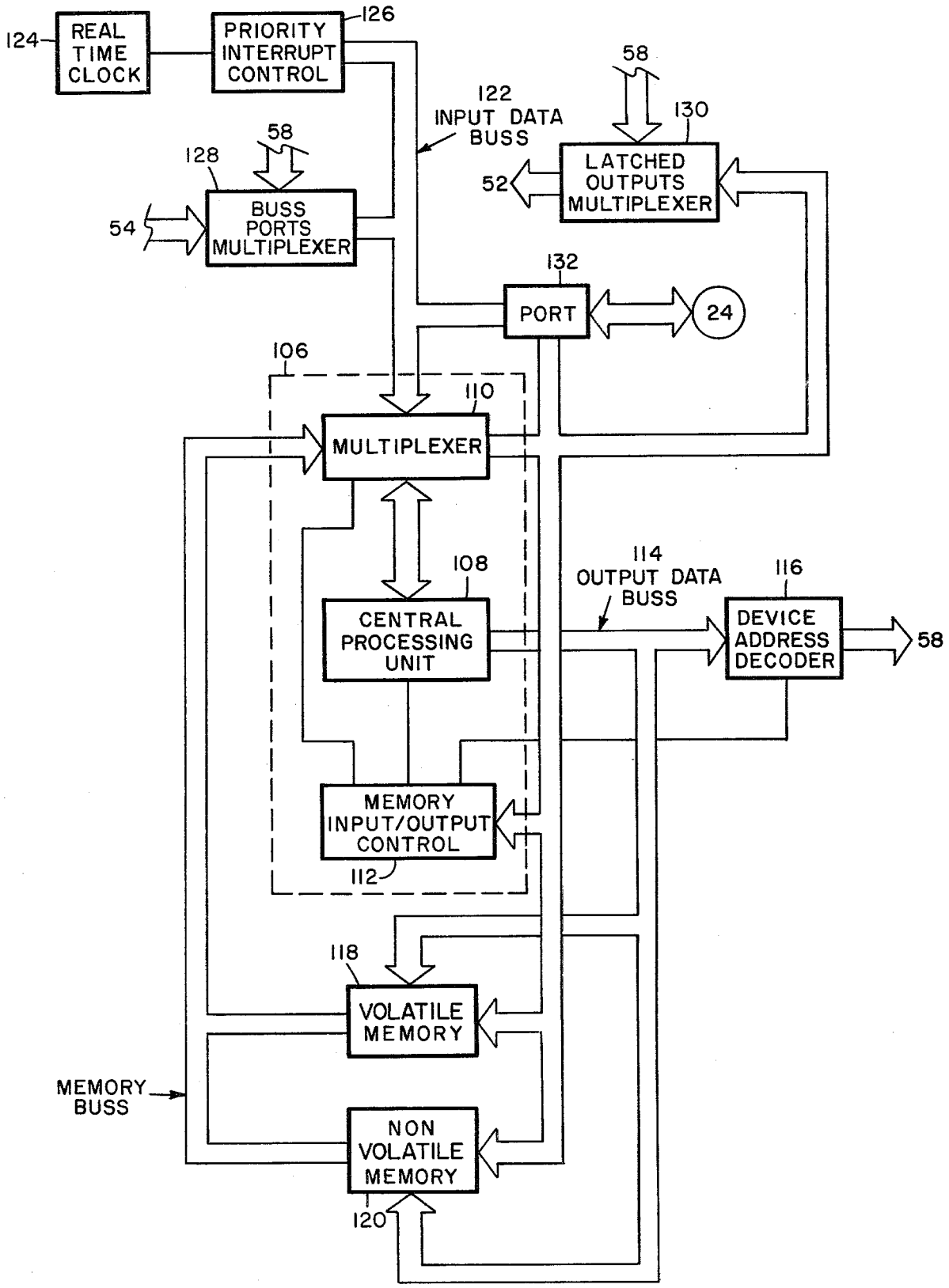
FIG. 6 is a block diagram of the microcomputer shown in FIG. 2.

Referring now to FIGS. 5 and 6 in combination, operation of the microcomputer 14 and operator console 32 is shown in more detail. In the operator console 32 there are actually three ports for feeding information between operator console 32 and microcomputer 14. In this preferred embodiment, the information is 8-line binary coded for digital operation. Inputs 52 from the microcomputer 14 are digital latched outputs that are being transmitted into the operator console 32. Outputs 54 feed information to the microcomputer 14 from the operator console 32. The outputs 54 are signals indicating that the operator of the train has performed a certain function as required when he reaches predetermined mile post markers. A warning that the operator is to perform these functions is provided by inputs 52 feeding into lamp drivers 56 to turn ON lamps on the console to indicate to the operator that he must perform certain functions or other information as would normally be given to the operator or engineer. Inputs 58 are select codes from the microcomputer and do the multiplexing necessary for the signals. Inputs 58 are solely within the microcomputer 14 and operator console 32 and have nothing to do with the operator console.

Once the non-volatile program has been inserted in the speed and location program input 24, the data is entered by the operator by pushing the enter data switch 60. Upon receipt of a system update request 62 on the operator console which is indicated by a lamp, the operator of the train would set in the mile post marker by setting the correct information into thumb wheel switches 64 that give a binary output therefrom. Next, upon receipt of a request for mile post input 68, the operator would push the mile post switch 66 to feed the information from the thumb wheel switches 64 into the microcomputer. Naturally the mile post switch 66 should only be pressed upon the passing of the particular mile post set on the thumb wheel switches 64. This allows the system to be updated and account for any minor variations that could be caused by any of a number of reasons, such as slippage of the wheel on the track.

The portion of the operator console 32 referred to by reference numeral 70 is the contingency section of the operator console. Assume for example that lamp 72 lights up, it would indicate approach to a siding along the track. Switches 74, 76 and 78 allow the operator to select the main line, siding 1 or siding 2, respectively. Lamps 80, 82 and 84 indicate if the correct selection was made. Many other items could be included in the contingency section 70 depending upon the amount of complexity someone would like to design into the system. The program would have to be written so that it will know each time a siding is being approached. Assume for example that the approach to siding lamp 72 lights up, the operator would then indicate through switches 74, 76 or 78 if he was taking the main line, siding 1 or siding 2, respectively. Assume that the operator presses siding 1 switch 76, lamp 82 would light up. If it was the correct selection, lamp 86 would also light up and the operator would acknowledge the correct selection by pushing acknowledgment of correct selection switch 88.

Warning section 90 will tell the operator if he is exceeding the speed limit set by the program by overspeed indicator lamp 92 and by audible alarm 94. To supply additional power to the audible alarm 94, a driver 96 may be necessary. Power for the audible alarm 94 is supplied by one shot 98 that feeds through OR gate 100 to the driver 96. The audible alarm 94 could have one of two modes. The first mode could be to turn the audible alarm 94 ON through the one shot 98 and to keep the audible alarm 94 ON until a reset is received via inputs 52 from the multiplexer in the microcomputer 14. In the second mode, a momentary sound could be given by the audible alarm 94 very similar to a beep that occurs when a "NO SMOKING" light comes ON on board a commercial passenger airline. The momentary sound would be provided by latch 102 via OR gate 100 and driver 96.

While all inputs from the microcomputer that are received into the operator console 32 are received via inputs 52 and 58, all outputs from the operator console 32 feed through reset switch latches 104 and outputs 54 to the microcomputer 14.

Referring now to FIG. 6, the microcomputer system consists basically of a microprocessor unit 106. Components as described in conjunction with the present invention are standard parts that may be purchased commercially. Particularly integrated circuit components manufactured by Control Logic are typical of the type integrated circuit components that may be used. Contained in the microprocessor unit 106 is a central processing unit 108 connected to multiplexer 110 and memory input/output control 112. The central processing unit 106 handles all of the addressing to and from memories and operate the system from the computer program (train order). As can be seen, there are many input and output busses entering and exiting the microprocessing unit 106. The busses provide the means for transferring information back and forth from memory. The data output buss 114 takes information from the microprocessing unit 106 and feeds it to device address decoder 116, to a volatile memory 118 and a non-volatile memory 120. The non-volatile memory 120 may provide the memory for the port for extraction of trip history 30 previously described in conjunction with FIG. 2. The volatile memory 118 may be erased or altered by a number of conditions, such as loss of power. Also the data output buss 114 feeds through the device address decoder 116 to give outputs 58 which correspond to inputs 58 in FIG. 5 of the operator console 32.

Between the multiplexer 110 and the central processing unit 108, there is a bidirectional exchange of information. The multiplexer 110 also receives information from the input data buss 122. Information, such as a real time clock 124 and priority interrupt control 126, may provide information to the multiplexer 110 through input data buss 122. The real time clock 124 works in conjunction with the priority interrupt control 126 so that after a predetermined period of time, the program is interrupted to update and keep track of the real time for the microcomputer 14.

Also feeding into the multiplexer 110 through input data buss 122 are outputs 54 from the operator console 32. Again the proper outputs are selected by a buss ports multiplexer 128. Because reference numerals 52, 54 and 58 are being used to refer to either inputs or outputs depending upon the manner in which they are being discussed, hereinafter they will be referred to as "I/O" with proper reference numerals. Selection of information to be fed into the multiplexer 110 is accomplished by I/O 58 received from device address decoder 116.

Also feeding into the multiplexer 110 are I/O's 52 via a latched outputs multiplexer 130 which are again selected by I/O's 58. This data is also fed to the volatile memory 118 and non-volatile memory 120. The program or train order under which the train is operated is fed into the microcomputer 14 by means of the speed and location program input 24 that connects through port 132 into the multiplexer 110 and also into the volatile memory 118 and non-volatile memory 120. The speed and location program input 24 may consist of a number of devices, such as a magnetic card reader.

The microprocessing unit 106 in volatile memory 118 may lose the information stored therein by any of a number of conditions, such as loss of power. However, the non-volatile memory 120 once programmed, stays programmed, and may be used in case of loss of power to restore the volatile memory 118 and reprogram microprocessing unit 106 upon restoring power. To change the information contained in non-volatile memory 120 is very difficult and requires quite a process. An automatic power-up sequence is included in the microprocessing unit 106 to reprogram the information from the non-volatile memory 120 in case of loss of power and restoring power thereto.

The device address decoder 116 is very important to the operation of the microcomputer 14. For any input/output operations to take place, the information to be transferred has its own special code. The central processing unit 108 selects the code and feeds it to the device address decoder 116. The device address decoder 116 in turn generates the signal sent to other devices as select lines referred to herein as I/O's 58.

Primarily the I/O's 58 are fed to (1) the operator console, (2) the latched outputs multiplexer 130, and (3) the buss ports multiplexer 128.

Port 132 provides a means for extracting the trip history from the microcomputer 6 via the port for extraction of trip history 30. Any particular type of system may be used, such as a magnetic card reader.

Inputs received into the system through the latched outputs multiplexer 130 are maintained until I/O's 58 are fed into the latched outputs multiplexer 130 to change the condition and select another code.

Figure 7:
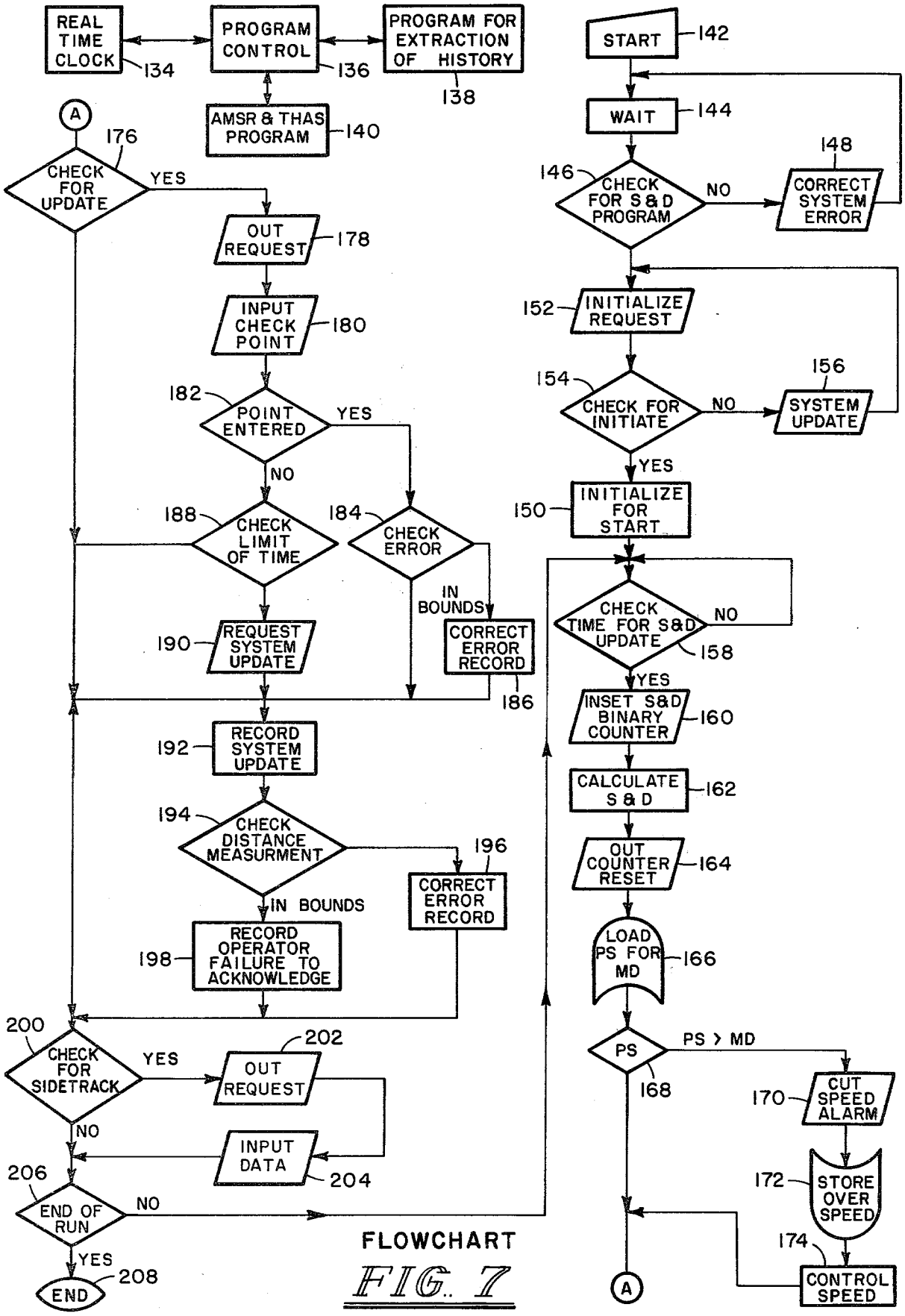
FIG. 7 is a flow chart of an operational system as previously shown in FIGS. 2–6.

Referring to FIG. 7 of the drawings, there is shown a flow chart of one possible program that could be used to control the operation of the microcomputer 14 and operator console 32. A real time clock 134 (previously designated 124 in conjunction with FIG. 6) operates in conjunction with a program control 136 and a program for extraction of trip history 138 to give an automatic maximum speed regulator and trip history acquisition system (AMSR & THAS) program 140. It is essential to keep track of real time as provided by real time clock 134. The program control 136 is the main control to operate all subprograms together. The program for extraction of trip history 138 is the port (previously indicated as port 132) through which the data stored in the non-volatile memory may be obtained to determine the trip history. The AMSR & THAS program takes the data, figures maximum speed, compares with actual speed and sends out a control signal to operate either the throttle or brakes.

Point A as shown in FIG. 7 is where the program is tied together in the flow chart. The program is started once the operator pushes the START button 142 (previously referred to in conjunction with FIG. 5 as the enter data switch 60). Next, the microcomputer goes through a routing wherein it waits 144 for a check for a speed and distance program 146. If there is a foul-up in the program, then a current system error 148 gives an output to interrupt the program. Assuming there is no problem with the program, the operator of the train will then give an initialize for start 150. However, this is only done after receiving as an input from the check for program 46 and initialize request 152. Also, there is a check for initiate 154, including system update 156, that can interrupt the operation of the train if no response is received.

A check time for speed and distance update 158 is also included that could interrupt operation if no update is received. Assuming that the program is GO (YES), an input from the speed and distance binary counter 160, which is in the form of pulses, is received by the calculate speed and distance 162. By knowing either the speed or the distance, the other can be calculated. From the calculate S&D 162, an out-counter reset 164 resets the memory that had been storing information from the counter referred to herein as load PS for MD 166.

The next step is to calculate the distance traveled since the initial start by using the information received from the calculated speed and distance 162. For convenience in the flow chart, this is referred to as PS 168. If the speed of the train is exceeding that programmed in memory (PS greater than MD), then a cut-speed alarm 170 would be activated and the information would be fed into a store overspeed 172. Also, the control speed 174 would be activated to reduce the speed of the train by either applying the brakes or the throttle. This information is fed into the check for update 176 as indicated by Point A.

The request for an update is indicated by out request 178 and the operator may respond by indicating input check point 180. This provides for an updating of the microcomputer 14 on a periodic basis. If the engineer or operator is performing his job, an update entered 182 will be indicated. A signal from the update entered 182 is then used to check error 184 and proceed if the amount of error is within given tolerances. If the error is within given tolerances, then a correct error record signal 186 is entered. If the engineer does not perform his duty by giving an update, a check limit of time 188 will so indicate. In other words, the operator of the train has a certain limit of time to respond to the update request. If the request system update 190 has not been timely received, operation of the train will be interrupted. A record system update 192 is fed into a check distance measurement 194. Then a correct error record signal 196 is generated. Also, if the operator fails to acknowledge, a record operator failure to acknowledge 198 is generated. In the operation of the train, the train should not be out of predetermined bounds upon reaching any particular check point. If the train is out of bounds, then there has been an error possible in the microcomputer 14. If the operator fails to acknowledge the update request, this information is fed into the trip history.

There are many other contingencies in the operation of a train, such as the check for side track 200. The operator must then indicate whether or not to continue on the main line or to enter the side track. If the operator enters the side track. then an out request 202 must be generated which must be acknowledged through an input data 204.

Upon the completion of the run, or the finishing of the train order programmed therein, the train will wait until the data is extracted by an end-of-run request 206. If the train is not finished, then it will return to the start of the program or check time for S&D update 158. If the trip is over, an end-of-trip indication 208 is given.

It should be realized that the above described program is only one of many that could be used in an on board microcomputer system implementing the present invention. By use of a preprogrammed train order that can be used to operate an on board microcomputer, the speed of the train can be very accurately controlled, monitored and/or regulated based upon initial track and/or train conditions. However, in cases of emergency the operator of the train may override the microcomputer system, but such action will be recorded in memory as part of the trip history.

By the use of the present system as described herein, engineers will be very reluctant to speed or violate safety regulations because such violations would be premanently recorded. If the railroads given unrealistic time schedules to the operator of the train, such information would also be indicated in the on board microcomputer 14 and the trip history.

We claim:

1. An apparatus for limiting maximum speed of a train having a throttle and brakes pursuant to a train order, said apparatus comprising:

means for preparing a non-volatile program from said train order including said maximum speeds;

computer means on board said train, said computer means being adapted to receive said non-volatile program from said preparing means into volatile and non-volatile memory means, trip history from said computer means being stored in said non-volatile memory means and said volatile memory means providing temporary memory storage for said computer means, said non-volatile memory means restoring said volatile memory upon loss of memory during a trip;

sensor means for detecting speed and location of said train and feeding said speed and location to said computer means;

comparison means in said computer means for comparing said non-volatile program with said speed and location from said sensor means and generating an overspeed signal if said maximum speed has been exceeded;

control means operated by said overspeed signal to reduce speed of said train to less than said maximum speed and updating means in said computer means for changing location indication of said train in said volatile memory in response to known location indicators.

2. The apparatus as given in claim 1 comprising emergency lockout means connected to said control means whereby an operator of said train can override said control means for safety reasons, said emergency lockout means having means for indicating when said control means has been overridden.

3. The apparatus as given in claim 2 comprising operator console means connected to said computer means, said operator console means allowing said operator to feed information to said computer means and vice versa.

4. The apparatus as given in claim 3 comprising extraction means connected to said non-volatile memory means for extracting said trip history upon completion of a trip.

5. The apparatus as given in claim 4 wherein said preparing means is a speed and location programmer located at a starting point for said train, said speed and location programmer being adapted to receive information from a remote location in preparing said non-volatile program from said train order.

6. The apparatus as given in claim 5 wherein said control means is a braking control operated by said overspeed signal for applying said brakes of said train.

7. The apparatus as given in claim 5 wherein said control means is a governor control operated by said overspeed signal for reducing said throttle of said train.

8. The apparatus as given in claim 5 wherein said sensor means includes magnetic sensors located adjacent a wheel of said train for generating a pulsed output having a frequency proportional to speed of said train.

9. The apparatus as given in claim 8 wherein said sensor means further includes shaping means and counter means for generating binary signals indicating said speed and location being fed to said computer means, said sensor means indicating direction of travel of said train to said computer means.

10. The apparatus as given in claim 3 wherein said operator console means includes alarm means activated by said overspeed signal to warn said operator said maximum speed has been exceeded.

11. The apparatus as given in claim 10 wherein said operator console means includes means for updating said computer means by feeding location of said train into said computer means at various intervals.

12. The apparatus as given in claim 11 wherein said operator console means includes contingency warning and acknowledgment means connected to said computer means for movement of said train in-and-out of various sidings.

13. A method of limiting speed of a train below certain maximums as established by a train order, said method consisting of the following steps:

preparing a non-volatile program at a train station from said train order by a speed and location programmer;

transferring said non-volatile program to said train at said train station;

first feeding said non-volatile program into a volatile and non-volatile memory of a computer on board said train via an input terminal;

starting operation of said train and said computer by an operator of said train via an operator console connected to said computer;

sensing speed and distance of said train by a sensor means on said train;

second feeding of said speed and distance from said sensor means into said computer;

comparing said speed from sensor means with said maximum speed in a comparator of said computer to give an overspeed signal if said maximum speed has been exceeded;

applying said overspeed signal to a control means to reduce speed of said train below said maximum speed;

recording trip history of said train in a non-volatile memory; and restoring said volatile memory from said non-volatile memory upon loss of memory during a trip.

14. The method of limiting speed of a train as given in claim 13 including as a final step extracting of said trip history from said non-volatile memory.

15. The method of limiting speed of a train as given in claim 14 including overriding said control means by said operator via override means in emergencies and indicating said overriding by said override means.

16. The method of limiting speed of a train as given in claim 15 wherein said sensing step includes detecting rotational velocity of a wheel of said train and generating a pulsed output therefrom proportional to speed of said train and computing therefrom location of said train by said computer, said sensing step indicating direction of movement of said train.

17. The method of limiting speed of a train as given in claim 16 including a further step of warning said operator of contingencies involving possible sidings as said train moves down a track.

18. The method of limiting speed of a train as given in claim 17 including periodic updating of location of said train to said computer via said operator and said operator console.

19. The method of limiting speed of a train as given in claim 18 wherein said applying step includes operation of brakes of said train by said control means.

20. The method of limiting speed of a train as given in claim 18 wherein said applying step includes operation of a governor of said train by said control means.

* * * * *